US005184642A

United States Patent [19]

Powell

[11] Patent Number: 5,184,642

[45] Date of Patent: Feb. 9, 1993

[54] AUTOMATIC WATER FAUCET OR WATER FAUCET CONTROLLER

[76] Inventor: Jay H. Powell, 1369 W. Greenleaf Apt. #201, Chicago, Ill. 60626

[21] Appl. No.: 703,904

[22] Filed: May 22, 1991

[51] Int. Cl.[5] ..... F16K 11/24

[52] U.S. Cl. ..... 137/607; 251/129.04

[58] Field of Search ..... 137/607, 606, 359, 360; 251/129.04; 4/192, 196, 623

[56] References Cited

U.S. PATENT DOCUMENTS 3,374,957 3/1968 Tyler ..... 137/606
3,904,167 9/1975 Touch et al. ..... 251/14
4,306,314 12/1981 Griffiths ..... 251/131
4,420,811 12/1983 Tarnay et al. ..... 137/561 R
4,654,900 4/1987 McGhee ..... 4/192 X
4,691,727 9/1987 Zorb et al. ..... 137/364 X
4,756,030 7/1988 Juliver ..... 137/334 X
5,025,825 6/1991 Gayton ..... 4/192 X

*Primary Examiner*—Stephen M. Hepperle
*Attorney, Agent, or Firm*—Robert Conte

[57] ABSTRACT

A retrofit system system for converting a conventional hot and cold water faucet arrangement to automatic electric control is disclosed. A solenoid valve and U-shaped tubes at either end are inserted into each riser. The valves are responsive to a control panel for setting flow rate and/or temperature.

9 Claims, 4 Drawing Sheets

AUTOMATIC WATER FAUCET OR WATER FAUCET CONTROLLER

BACKGROUND OF THE INVENTION

1. Field of the Invention

The invention relates to a device and method for electrically controlling the temperature and flow of water for use at any sink(lavatory) with a preexisting faucet.

2. Description of Prior Art

There are many apparatus to control the temperature and flow of water through output means. They are concerned with precise temperature and flow provision and retention while providing temperature and flow readout for comfortable water contact. They have no concern for low cost or ease of implementation.

Because sink use does not require specific temperatures that must be maintained in case of hot or cold water flow change, general temperatures may be used. Hot, Warm and Cold and limited steps between can be used to sufficiently provide a competent range of temperatures. Low, medium and high flows sufficiently provide water volume needs. And due to its valve system design, installation of the apparatus is quick and simple.

There exist apparatus designed for sink use that are activated by placing the hands within range of infrared sensing means initiating water flow. When the hands are removed from the area of sensing the flow of water stops or is timed to stop. These apparatus do not offer single step temperature adjustment. Some must be adjusted manually. This limits the use by the handicapped who cannot turn a manual adjustment. These apparatus also replace the existing faucet means which disallows the personal selection of faucet design, increases the cost of the apparatus substantially and creates a chore and great expense to implement.

SUMMARY OF THE INVENTION

The present invention is a method and apparatus for controlling the temperature and flow of water at any typical sink. A typical sink is one which uses inlet valves and complementary faucet risers connected by compression fittings(atypical sink plumbing will require alternative fittings).

An object of this invention is to provide two separate valve assemblies, each to be installed in-line, one to control the flow of hot water and one to control the flow of cold water for the continued, optional, manual use of the preexisting faucet.

Another object of this invention is to provide ease of implementation of the valve assemblies by using semicircularly formed flexible and rigid tubing with standard compression connections.

Another object of this invention is to provide a cordless touch sensitive control panel assembly to accept command input(user instructions).

Another object of this invention is to provide alternative graphic representations of temperature and flow on the control panel to target various end users.

Another object of this invention is to provide voice activation to complement or replace the control panel assembly whenever more competent, cost efficient technology is available.

DETAILED DESCRIPTION OF THE PREFERRED EMBODIMENT

The preferred embodiment of the invention is made up of four primary assemblies: Two Valve Assemblies FIG. 1, the Main Control Assembly 2, and the Control Panel Assembly FIG. 3. FIG. 2 is a see-through vanity/lavatory drawing to show how the apparatus is typically installed.

Figure 1A:
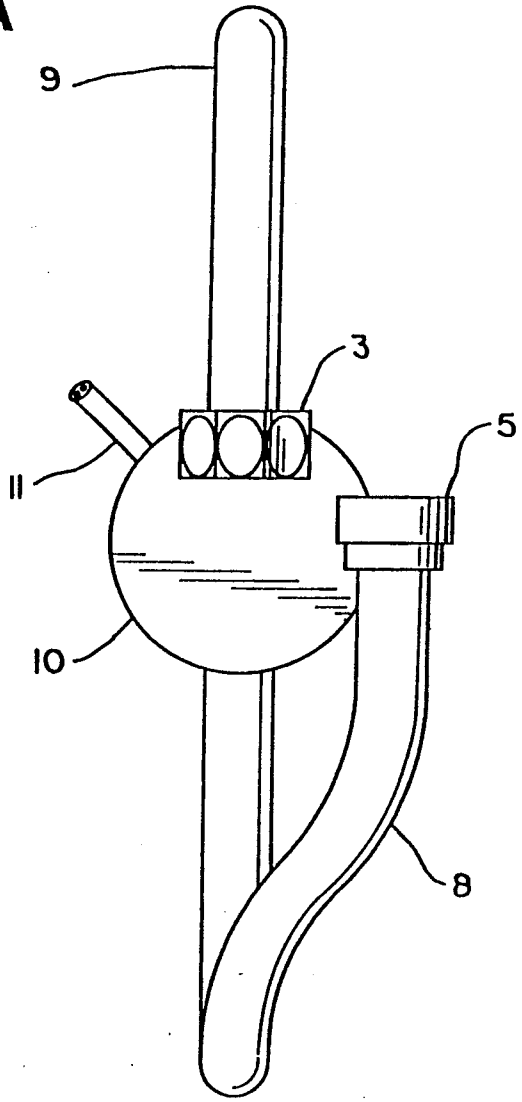
FIG. 1 is a front and side view of the valve assemblies, which includes various positions of the flexible tubing.
Figure 1:
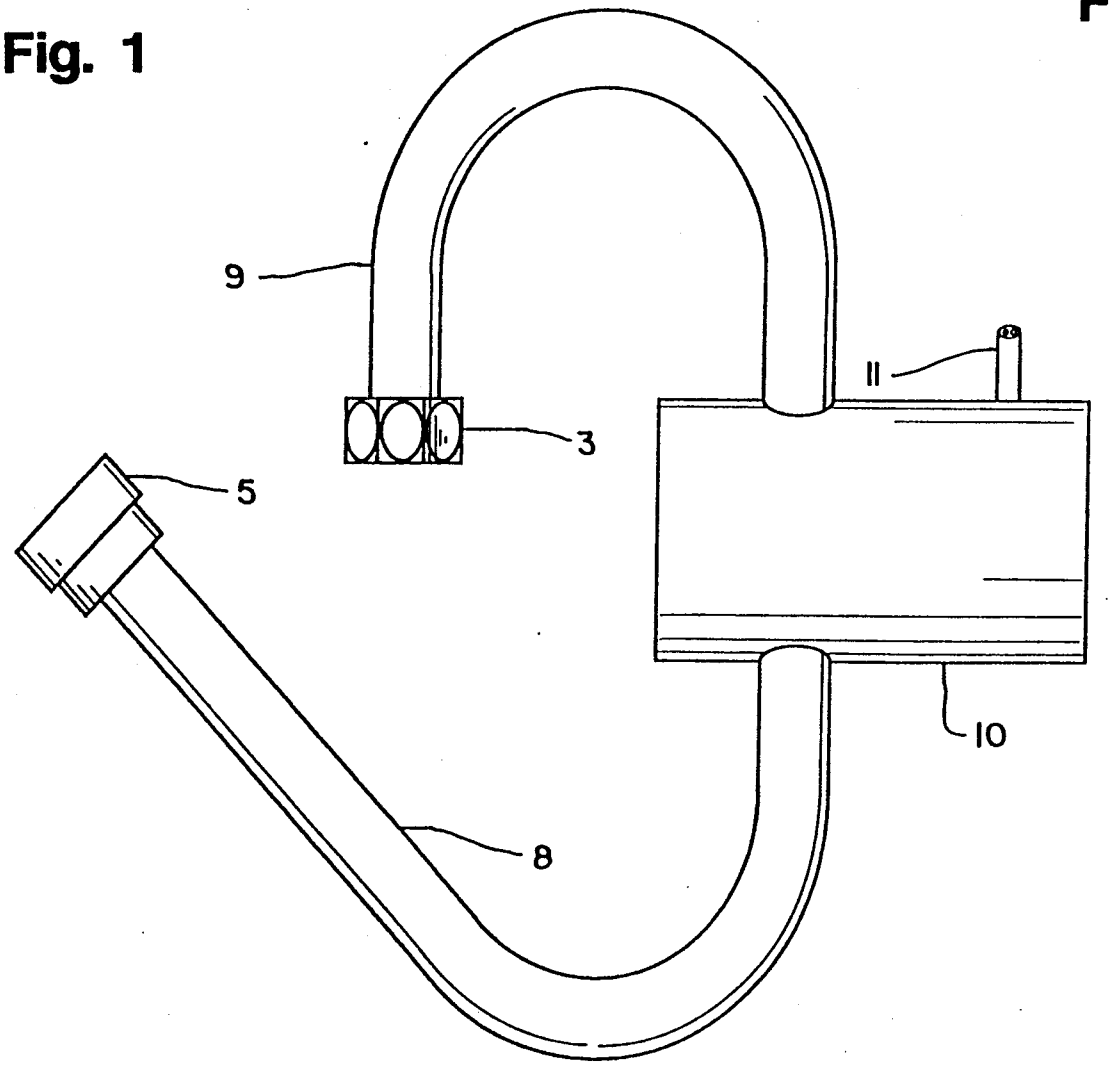
Figure 2:
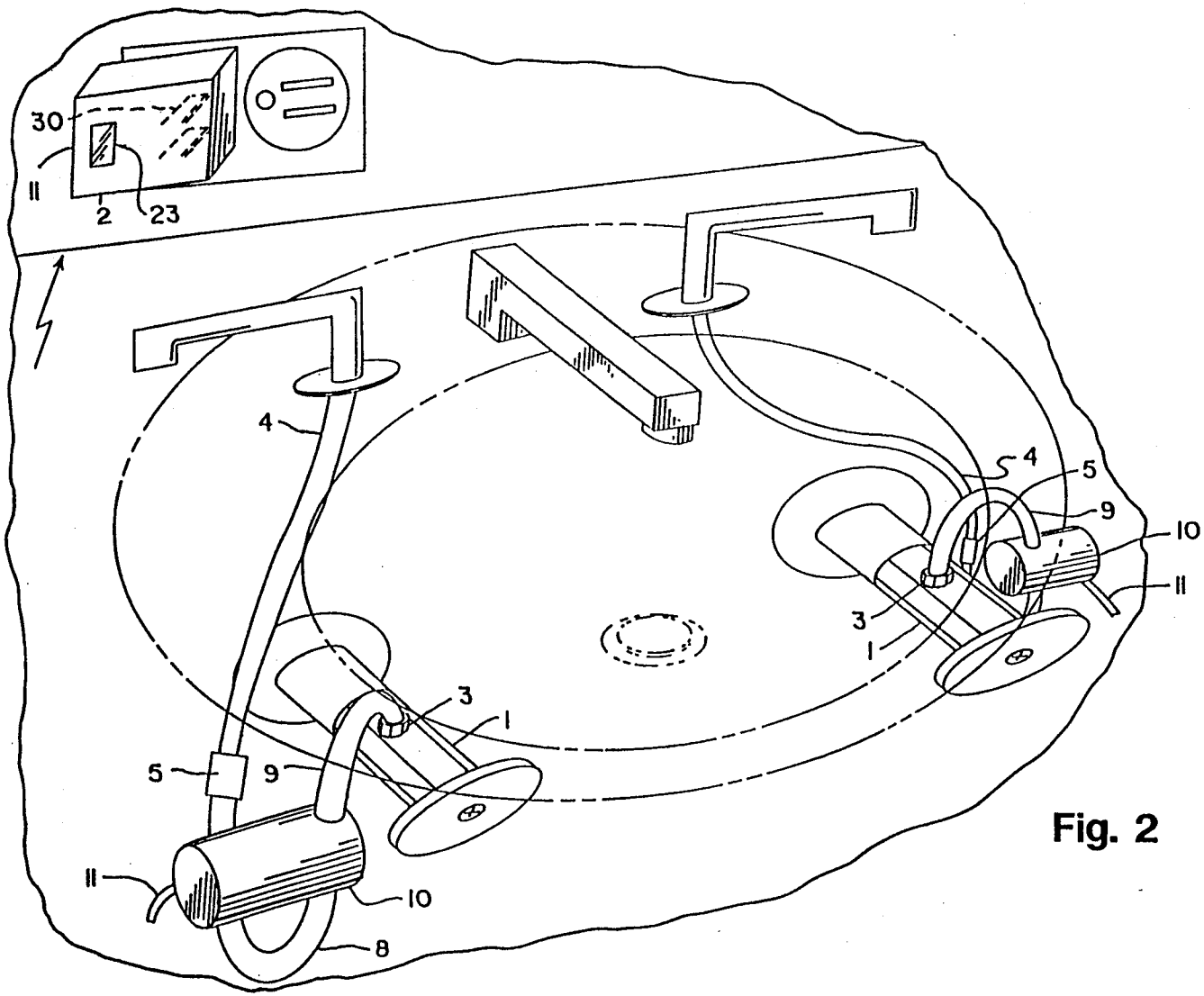
FIG. 2 is an elevational view of a see-through vanity and lavatory application of the preferred embodiment.

There are two separate but identical valve assemblies FIG. 1. One Valve Assembly is for cold water control and the other Valve Assembly is for hot water control. Each valve assembly has an electrically operated valve 10. In the preferred embodiment, solenoid valves are used, however other types of electronically operated valves may be used.

Separate U-shaped tubing is connected to each valve's input port and output port. The U-shaped, rigid input tubing 9 connected to the input of each valve 10 has, on the opposite end, a compression sleeve and compression nut(male compression fitting 3) for connection to the preexisting inlet valve's female compression fitting. The rigid input tubing can be rotated at the valve's input to allow for space requirements. The U-shaped, flexible output tubing 8 connected to the output of each valve 10 has, on the opposite end, a female compression fitting 5, to accept the preexisting faucet riser's male compression fitting.

Each preexisting hot and cold faucet riser 4 is disconnected from its inlet valve 1. To install the apparatus, the input tubing 9 is connected to the designated inlet valve 1. The output tubing 8 is connected to the designated faucet riser 4 thus reconnecting the individual paths of flow of both hot and cold water.

Figure 3:
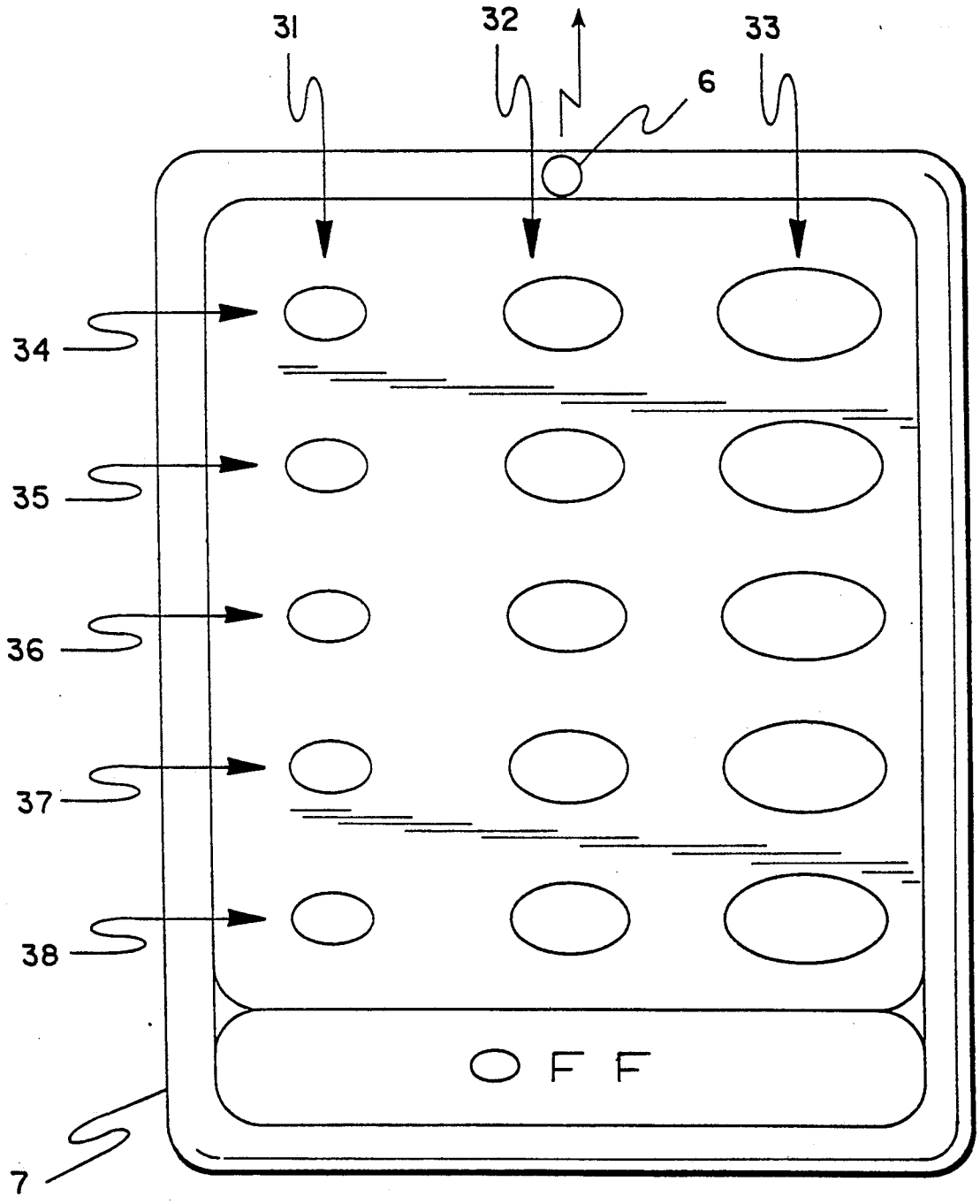
FIG. 3 is a front view of the control panel assembly and control panel with an example of graphic design.
Figure 4:
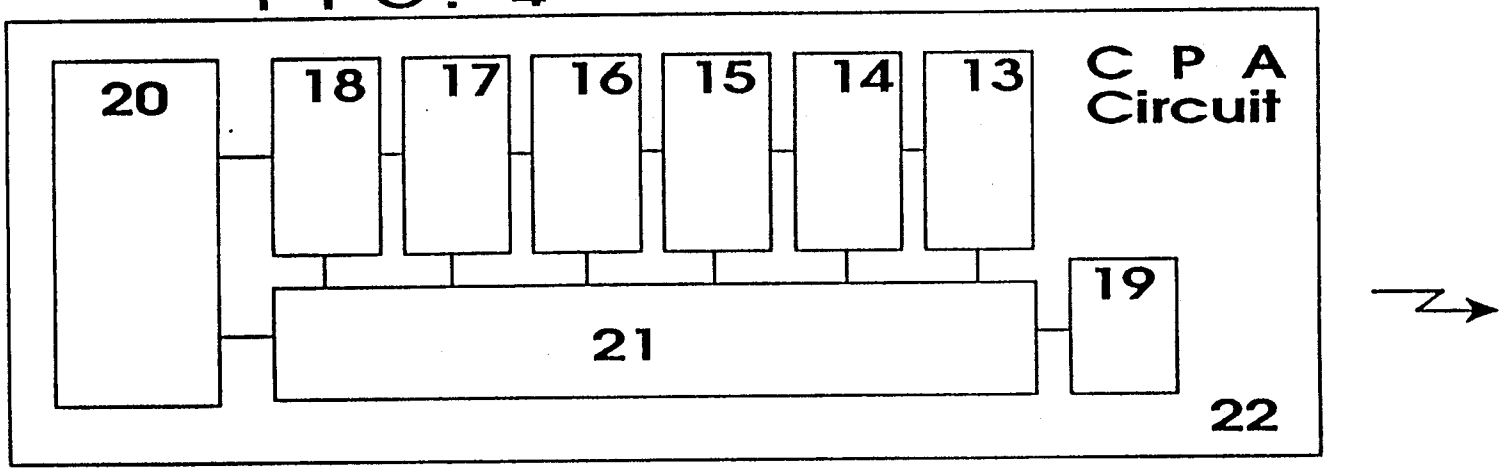
FIG. 4 is a block diagram of the Control Panel Assembly Circuit.
Figure 5:
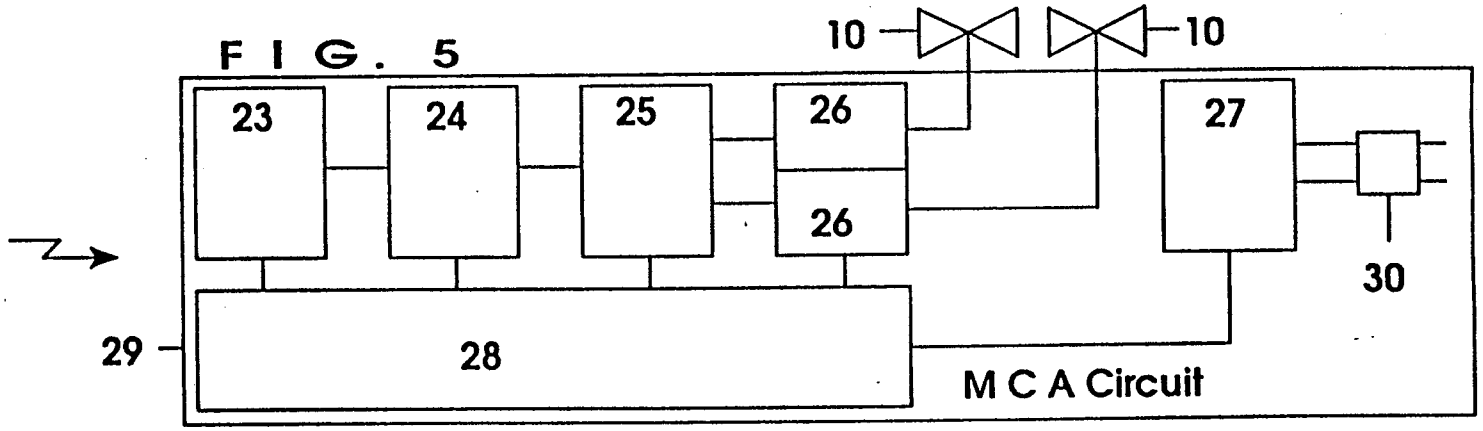
FIG. 5 is a block diagram of the Main Control Assembly Circuit.

The Control Panel Assembly(CPA) FIG. 3 contains a Control Panel 7 and CPA circuit 22. The CPA circuit 22 includes the CPA Keyboard Encoder 16, the Programmable Encoder 15 and the CPA Modulator 14 to translate command input into visible or infra-red light(in the preferred embodiment infra-red light will be used) 6. This circuit will require low power. As such, a long life battery 20, typically lithium, will be used. The Control Panel 7 need only be touched to accept command input, typically by capacitance, although other sensing methods, such as piezo technology, could be used. Voice activation would be used as a complement to the Control Panel 7 in the preferred embodiment when competent, cost efficient technology is available, and would likely exist as part of the Main Control Assembly 2 and MCA Circuit 22.

The Control Panel 7 consists of sixteen sensor areas: one for 'off', and fifteen combinations of flowrate and temperature. In the preferred embodiment, Each row of sensor areas signifies a general temperature(top to bottom): Hot 34, Warm-hot 35, Warm 36, Lukewarm 37, Cold 38. Each column of sensor areas signifies amount of water flow(left to right): Low 31, Medium 32, High 33. Touching a sensor area of particular temperature and flow or 'Off' will activate a particular capacitance-operated sensor 18, which performs the switching function. The operation needs only contact, in contrast to mechanical devices, which require activating force. N-key rollover 17 will eliminate any confusion if multiple keys are touched. The CPA Keyboard Encoder 16 will convert each of the sixteen sensor areas touched to a data nibble; output in parallel. The data nibble is input to the Programmable Encoder 15. An audible signal transducer 19 is included as feedback to verify sensor area contact.

The input data is available in parallel form as presented from the the CPA Keyboard Encoder 16. Before receipt of a send signal, the Programmable Encoder 15 is in a low power standby state. The Programmable Encoder 15 is clocked by a Resistor and Capacitor(RC) Oscillator which typically runs at a frequency of 4 kHz to 9 kHz. The Programmable Encoder 15 receives parallel input data and outputs an address-encoded serial data stream. Address lines can be varied and are in one of three states, resulting in the ability to accomodate a multiplicity of different access codes. A low level on the transmit pin will initiate transmission. Each encoding transmission consists of two identical words, serially sent. This data serves as the input to the gated oscillator portion 14 of the Modulator.

The Modulator 14 changes the data received into infra-red or visible light(the preferred embodiment uses infra-red light) by attaching the data to a carrier and passing the data through a light emitting diode(LED) 6. Serial data sent from the Programmable Encoder 15 to a gated RC oscillator 14 will typically generate a data-modulated square wave. This square output waveform is the data superimposed on a 50 kHz carrier waveform. The data-modulated wave is driven through an infra-red(preferred) LED 6 by a Field Effect Transistor(-FET). A resistor serves to limit the current through the LED.

The Main Control Assembly 2, contained within an adaptor type casing, includes the Main Control Assembly(MCA) Circuit of the apparatus. The MCA Circuit detects the infra-red from the Control Panel Assembly FIG. 3 and directs the valve operations through Cable Assembly 11. A non-isolated non-transformer power supply 27 and input plug 30 will power this system. "Glue Logic" underlies the functioning of all circuit elements 21, 28.

The MCA Circuit 29 contains the Detector and Demodulator 23, Programmable Decoder 24 and Programmable Chip 25. The Detector and Demodulator unit 23 receives the infra-red light(preferred) transmission and strips the data from its carrier. Infra-red is input to the detector/receiver diode which operates at a typical peak wavelength of 940 nm. The detector/-receiver diode is AC coupled to the amplifier chip via a capacitor to eliminate direct current. The gain of the amplifier is set by a tank and RC oscillator in series. Means have been provided to compensate for sensitivity to ambient light. An external capacitor strips the data from the carrier. Data is available at output in digital form and is received by the Programmable Decoder 24.

The Programmable Decoder 24 receives a serial stream of two words per encoding sequence. The address sent must match the local address and be repeated in the second word for security purposes. Likewise, the 4-bits of data must be repeated in both data words. If this occurs, then Valid Transmit(VT) goes high and the data is latched and output. The Programmable Decoder's 24 clock's frequency is near identical to the Programmable Encoder's 16.

A Smart Programmable Chip 25 accepts parallel input data from the Programmable Decoder 24 and outputs two serial timing patterns, one for each valve channel. Each valve 10 is wired to the MCA Circuit 29 via Cable Assembly 11. The two patterns act upon the Hot and Cold Water Valves 10, via individual drivers 26. Thus, two different timing sequences generate a water stream of defined temperature and flowrate. Each individual driver accepts serial timing patterns in such a way that the driving signal to the subsequent valve is an integral multiple of a zero-crossed, line synchronized AC sinewave pulse, typically 60 Hz.

What is claimed is:

1. A water faucet comprising:

a hot water supply riser, a cold water supply riser, at least one manually operated water flow control valve, and an effluent spout for supplying a stream of effluent water mixed from said hot and cold water supplies;

a control panel for operation by a user for approximately selecting a plurality of effluent temperatures and a plurality of effluent flow rates; said control panel having a plurality of button means requiring minimal pressure by a user for activation; said control panel producing a signal of visible or invisible light indicative of said desired effluent temperature and/or flow rate;

a hot water supply pipe;

a cold water supply pipe;

an electrically operated hot water control valve interposed between said hot water supply riser and said hot water supply pipe;

an electrically operated cold water control valve interposed between said cold water supply riser and said cold water supply pipe;

a control device responsive to said light signal produced by said control panel and each of said button means, said control device being electrically connected to said electrically operated hot and cold water control valves for generating electrical signals suitable for controlling said valves;

said electrically operated hot water control valve having a hot water flow rate control member, an electrically operated solenoid responsive to said control device for controlling the position of said hot water flow rate control member, a hot water input port, a hot water output port, a substantially U-shaped input tube attached to said hot water output port; a substantially U-shaped hot water output tube attached to said hot water output port; said hot water input tube and hot water output tube being disposed in opposition to one another; said hot water output tube having means for attachment to said hot water supply pipe; said hot water output tube having means for attachment to said hot water supply riser; and said electrically operated cold water control valve having a cold water flow control member, an electrically operated solenoid responsive to said control device for controlling the position of said cold water flow rate control member, a cold water input port, a cold water output port, a substantially U-shaped input tube attached to said cold water input port; a substantially U-shaped cold water output tube attached to said cold water output port; said cold water input tube and said cold water output tube being disposed in opposition to one another; said cold water input tube having means for attachment to said cold water supply pipe; said cold water output tube having means for attachment to said cold water supply riser.

2. A retrofit device to automatically control the temperatures and/or flow rate of an existing water faucet comprising:

user-operable control panel for approximately selecting a plurality of effluent temperatures and/or flow rates;

a control device responsive to said control panel for producing a first indicia corresponding to a first desired water temperature and/or flow rate, and a second indicia corresponding to a second desired water temperature and/or flow rate;

an electrically operated hot water valve means to be interposed between a hot water supply riser and a hot water supply pipe, said hot water valve means connected to said control device and responsive to said control device for controlling the amount of hot water in an effluent stream; electrically operated hot water valve having a hot water flow rate control member, an electrically operated solenoid responsive to said control device for controlling the position of said hot water flow rate control member, a hot water input port and a hot water outlet port, a substantially U-shaped hot water input tube attached to said hot water input port; a substantially U-shaped hot water output tube attached to said hot water output port; said hot water input tube and said hot water output tube being disposed in opposition to one another; said hot water input tube having means for attachment to said hot water supply pipe; said output tube having means for attachment to said hot water supply riser; and said electrically operated cold water control valve having a cold water flow control member, an electrically operated solenoid responsive to said control device for controlling the position of said cold water flow rate control member, a cold water input port and a cold water output port, a substantially U-shaped cold water input tube attached to said cold water input port; a substantially U-shaped cold water output tube attached to said cold water output port; said cold water input tube and said cold water output tube being disposed in opposition to one another; said input tube having means for attachment to said cold water supply pipe; said cold water output tube having means for attachment to said cold water supply riser.

3. The retrofit device of claim 2 wherein said control panel has means for producing indicia of visible or invisible light corresponding to a plurality of temperature and/or flow rate selections; and said control device is responsive to said light indicia.

4. The retrofit device of claim 3 wherein said control panel is a capacitive membrane control panel requiring application of minimal pressure by a user for activation.

5. The retrofit device of claim 3 wherein said control panel is a piezo-electric membrane control panel requiring application of minimal pressure by a user for activation.

6. A water faucet comprising:

a hot water supply riser, a cold water supply riser, at least one manually operated water flow control valve, and an effluent spout for supplying a stream of effluent mixed from said hot and cold water supplies;

a control panel for operation by a user for approximately selecting a plurality of effluent temperatures and a plurality of effluent flow rates;

a hot water supply pipe;

a cold water supply pipe;

an electrically operated hot water control valve interposed between said hot water supply riser and said hot water supply pipe;

an electrically operated cold water control valve interposed between said cold water supply riser and said cold water supply pipe;

a control device electrically connected to said electrically operated hot and cold water control valves for generating electrical signals suitable for controlling said valves;

said electrically operated hot water control valve having a hot water flow rate control member, an electrically operated solenoid responsive to said control device for controlling the position of said hot water flow rate control member, a hot water input port, a hot water output port, a substantially U-shaped input tube attached to said hot water input port, a substantially U-shaped hot water output tube attached to said hot water output port; said hot water input tube and said hot water output tube being disposed in opposition to one another, said hot water input tube having means for attachment to said hot water supply pipe, said hot water output tube having means for attachment to said hot water supply riser, and said electrically operated cold water control valve having a cold water flow rate control member, an electrically operated solenoid responsive to said control device for controlling the position of said cold water flow rate control member, a cold water input port, a cold water output port, a substantially U-shaped input tube attached to said cold water input port, a substantially U-shaped cold water output tube attached to said cold water output port, said cold water input tube and said cold water output tube being disposed in opposition to one another, said cold water input tube having means for attachment to said cold water supply pipe, said cold water output tube having means for attachment to said cold water supply riser.

7. The water faucet of claim 6 wherein said control panel has an operator control means; said control panel producing a signal of visible or invisible light indicative of said desired effluent temperature and/or flow rate; and said control device being responsive to said light signal produced by said control panel, and said control device being electrically connected to said electrically operated hot and cold water control valves for generating electrical signals suitable for controlling said valves.

8. A retrofit device to automatically control the temperature and/or flow rate of an existing water faucet comprising:

a control panel for operation by a user for approximately selecting a plurality of effluent temperatures and a plurality of effluent flow rates;

an electrically operated hot water control valve to be interposed between a hot water supply riser and a hot water supply pipe;

an electrically operated cold water control valve to be interposed between a cold water supply riser and a cold water supply pipe;

a control device electrically connected to said electrically operated hot and cold water control valves for generating electrical signals suitable for controlling said valves;

said electrically operated hot water control valve having a hot water flow rate control member, an electrically operated solenoid responsive to said control device for controlling the position of said hot water flow rate control member, a hot water input port, a hot water output port, a substantially U-shaped input tube attached to said hot water input port, a substantially U-shaped hot water output tube attached to said hot water output port, said hot water input tube and said hot water output tube being disposed in opposition to one another, said hot water input tube having means for attachment to said hot water supply pipe, said hot water output tube having means for attachment to said hot water supply riser; and said electrically operated cold water control valve having a cold water flow rate control member, an electrically operated solenoid responsive to said control device for controlling the position of said cold water flow rate control member, a cold water input port, a cold water output port, a substantially U-shaped input tube attached to said cold water input port, a substantially U-shaped cold water output tube attached to said cold water output port, said cold water input tube and said cold water output tube being disposed in opposition to one another, said cold water input tube having means for attachment to said cold water supply pipe, said cold water output tube having means for attachment to said cold water supply riser.

9. The retrofit device of claim 8 wherein said control panel has an operator control means, said control panel producing a signal of visible or invisible light indicative of said desired effluent temperature and/or flow rate; and said control device being responsive to said light signal produced by said control panel and said control device being electrically connected to said electrically operated hot and cold water control valves for generating electrical signals suitable for controlling said valves.

* * * * *